US005150725A

United States Patent [19]

Cunningham et al.

[11] Patent Number: 5,150,725

[45] Date of Patent: Sep. 29, 1992

[54] FILTER TIPPED SMOKING RODS

[75] Inventors: Linda J. Cunningham, Co. Down; Brian Adams, Templepatrick; William Barham, Belfast, all of Ireland

[73] Assignee: Gallaher Ltd., England

[21] Appl. No.: 654,465

[22] Filed: Feb. 13, 1991

[30] Foreign Application Priority Data

Feb. 13, 1990 [GB] United Kingdom ..... 9003248

[51] Int. Cl.[5] ..... A24D 1/02

[52] U.S. Cl. ..... 131/365; 131/336

[58] Field of Search ..... 131/336, 365

[56] References Cited

U.S. PATENT DOCUMENTS

| | | | |
|---|---|---|---|
| 2,980,116 | 11/1958 | Schor | 131/336 |
| 4,034,765 | 7/1977 | Hall | 131/336 |
| 4,386,618 | 6/1983 | Cantrell | 131/336 |

FOREIGN PATENT DOCUMENTS

| | | |
|---|---|---|
| 255114 | 2/1988 | European Pat. Off. . |
| 68807 | 11/1973 | Luxembourg . |
| 938902 | 10/1963 | United Kingdom . |
| 2091078 | 7/1982 | United Kingdom . |
| 2105171 | 3/1983 | United Kingdom . |

*Primary Examiner*—Vincent Millin
*Assistant Examiner*—Lynne A. Reichard
*Attorney, Agent, or Firm*—Sughrue, Mion, Zinn, Macpeak & Seas

[57] ABSTRACT

A tipped smoking rod comprising a tobacco rod 2, a filter tip 1 adjacent one end of the tobacco rod which comprises a filter body 3 enclosed within plugwrap material 4, and a tipping overwrap 6 material around the filter tip and the said adjacent end of the tobacco rod, wherein both the plugwrap and the tipping overwrap each comprise a pattern of perforations 7,8 which are selected to give an area of overlap of perforations of at least 0.2 $mm^2$ which is substantially unaffected by the relative positions of the plugwrap and tipping overwrap.

23 Claims, 3 Drawing Sheets

FILTER TIPPED SMOKING RODS

BACKGROUND OF THE INVENTION

A tipped cigarette or other tipped smoking rod comprises a tobacco rod and a filter tip secured adjacent to one end of the tobacco rod. The filter tip comprises a filter body, that may be of homogeneous or heterogeneous construction, and that is enclosed within a sheet material, generally in cylindrical form, that is often termed a "plugwrap" material. The tip is held to the end of the tobacco rod by an outer wrapping material that is wrapped around the tip and the end of the tobacco rod, and that is often termed a "tipping overwrap" material, or a "cork" material. The tipping overwrap is generally coloured brown.

It is often required that the filter should contribute a significant amount of ventilation to the smoke stream being drawn through the filter and accordingly the wrapped laminate created by the tipping overwrap and the plugwrap must be such as to permit the desired degree of airflow through the laminate and into the filter body. If both materials have very low permeability then there will be inadequate ventilation. If both are highly permeable (for instance up to about 600 Coresta) there will be too much ventilation. It has therefore been accepted that it is desirable for the tipping overwrap to be of substantially impermeable material that is perforated to provide ventilation, and it is then necessary for the plugwrap to be permeable underneath the perforations, so as to give the desired ventilation into the filter body.

The use of a permeable plugwrap, for instance having a permeability in the range 200 to 650 Coresta, is therefore common but does incur the known result that the smoke quality is rather bland. Some smokers would prefer to have a more stringent smoke quality from a filter cigarette. It is known that this can be achieved if the plugwrap material is substantially impermeable but is provided with perforations in registration with the perforations through the tipping overwrap. Unfortunately it is extremely difficult to provide in an economic manner a reliable degree of registration of the two sets of perforations, and any variation in registration will inevitably result in variation in ventilation. It should be noted that it is important that the degree of ventilation is substantially uniform from one smoking rod to another as otherwise the smoke qualities will vary from one rod to another.

Registration problems are eliminated if the tipping overwrap and plugwrap are perforated simultaneously, after assembly of the smoking rod. This is described in, for instance, U.S. Pat. No. 4,564,030 and EP 255,114. Unfortunately it is difficult to perform in practice. It is necessary for there to be a large number (e.g., at least 10) peforations distributed around the smoking rod. The most practicable way of achieving these perforations is by rotating the rod as it travels longitudinally past the perforating apparatus. The preferred perforating apparatus is a laser. Unfortunately suitable lasers are expensive, cannot be fitted to all types of cigarette making machines and their use results in a loss of cigarette making efficiency. Also the laser itself is under-utilised because the cigarette making machine has to run at a linear speed that is much less than the linear speed at which the laser could give satisfactory perforations. Another source of inefficiency is that a significant number of cigarette rods are liable to be broken during the high speed rotation of them.

One possibility that we have considered is the provision of perforations uniformly distributed over the entire plugwrap material. Unfortunately this proves impracticable. If the perforations are sufficiently close to one another to try to ensure a sufficient degree of registration of the two sets of perforations to give the necessary ventilation, the extent of perforation of the plugwrap is so great that the plugwrap has insufficient longitudinal strength to withstand the forces to which it is subjected during the manufacture of the filter rod and subsequently the smoking rod. However there are unsatisfactory variations in the degree of registration and if the overall perforation is reduced to promote longitudinal strength, then the degree of ventilation becomes even more variable.

In GB 2,105,171 it is proposed to provide a plugwrap which has a regular array of apertures that are arranged in staggered transverse rows (i.e. perpendicular to the length direction of the plugwrap) and staggered lengthwise columns whereby the total length of void traversed by any two transverse lines is the same. The plugwrap apertures have a width about 2.5 mm. The tipping overwrap has perforations that are small relative to the plugwrap perforations, the tipping overwrap perforation typically being 0.01 to 0.5 mm in diameter.

There is no suggestion where the said transverse lines should be positioned and this system has serious disadvantages. The very large perforations in the plugwrap material weaken it and this can cause handling problems, especially when the filter body is a heterogeneous construction having voids such as shown in FIG. 3 of GB 2,105,171. Another disadvantage is that the very large perforations in the plugwrap material allow the stained filter body to be readily visible through perforations in the tipping overwrap, and this can be highly undesirable.

Another, and fundamental, problem with the arrangement is that it does not suggest how to provide uniformity of ventilation from one filter tip to another. Uniformity would perhaps be available if the perforations in the tipping overwrap were replaced by continuous transverse slots, since the same area of perforations would then be exposed irrespective of the longitudinal and transverse positioning of the tipping overwrap with respect to the plugwrap. In reality however the tipping overwrap perforations have to be discrete apertures and the extent to which they overlap the large perforations will depend upon chance. For instance if the perforations in the transverse row had a pitch identical with the pitch between the longitudinally extending rows in the plugwrap, the extent of overlap could range from 100 to 0%, depending upon the radial positioning of the tipping overwrap relative to the plugwrap.

A particular problem arises in ventilated filter tips in that it is often preferred that the perforations in the tipping overwrap should be relatively large so that they are visible to the naked eye, and if the perforations through the plugwrap are also relatively large then the degree of ventilation would be much too high. Accordingly these smoking rods require that the perforations through the plugwrap should be smaller than the perforations through the tipping overwrap, and this creates additional difficulties both when the plugwrap is to be perforated in a pre-assembled smoking rod and when it is necessary to achieve uniform registration of previously perforated tipping overwrap and plugwrap.

The present situation therefore is that it is known that improved smoke characteristics can be achieved if the plugwrap and tipping overwrap are both perforated but otherwise substantially impermeable materials, but that there is no satisfactory method of making such filters. Either the perforations are made simultaneously by machinery that is very expensive and inefficient, or the materials are perforated previously and a consistent degree of ventilation is not obtained.

SUMMARY OF THE INVENTION

According to the invention a tipped smoking rod comprises a tobacco rod, a filter tip adjacent one end of the tobacco rod and comprising a filter body enclosed within plugwrap material, and a tipping overwrap material around the filter tip and the said adjacent end of the tobacco rod, and in this smoking rod the plugwrap material is selected from first and second sheet materials and the tipping overwrap material is the other of the first and second sheet materials, the first sheet material is a substantially impermeable sheet material that has been provided with a first pattern of first perforations, and the second sheet material is a substantially impermeable sheet material that has been provided with a second pattern of second perforations, the perforations are all between 0.01 and 1 mm in each dimension, the first pattern comprises one or a plurality of parallel first rows of first perforations in a predetermined arrangement within each row, the second pattern comprises one or a plurality of parallel second rows of second perforations in a predetermined arrangement within each second row, and the first and second patterns are selected such that there is an area of overlap of first and second perforations that is at least 0.2 $mm^2$ and that is substantially unaffected by the relative positions of the tipping overwrap and the plugwrap materials.

Thus in the invention, the two sets of perforations are each arranged in a predetermined pattern and these patterns are selected such that there is a predetermined and substantially uniform degree of overlap between the perforations in the patterns, substantially regardless of the precise positioning of the tipping overwrap relative to the plugwrap. Thus, for the first time, it is possible to pre-perforate the plugwrap and to pre-perforate the tipping overwrap with perforations of convenient size and then to assemble the smoking rods in conventional manner and at high speed, and obtain substantially constant ventilation in every smoking rod.

The pattern in each of the sheet materials can be very complex. For instance it can use perforations within each sheet material that are of variable size and/or of variable separation and/or variable shape. Arithmetic description of the relationship between the patterns will, in those circumstances, be similarly complex but can be devised by conventional arithmetic models so as to obtain a substantially constant and desired degree of ventilation. It is generally preferred however, that each of the patterns should be regular, and this has the advantage that it is much easier to manufacture such patterns either by laser perforation or by mechanical perforation. Thus preferably the perforations are regularly arranged in rows.

It is possible to obtain the desired constant degree of overlap with the second rows extending longitundinally (provided the transverse spacing of the rows is appropriate) but with the perforations in them staggered with respect to each other in the transverse direction, with the result that this second pattern could be regarded as consisting of a transverse zigzag pattern. Preferably however, the first pattern consists of first rows extending longitudinally and the second pattern consists of second rows extending transversely, with the degree of overlap thus being defined by the intersections between the longitudinal and transverse rows.

It is necessary for at least one of the patterns to comprise a plurality of rows, as otherwise there will only be one intersection point between the patterns. Generally there are a plurality of first longitudinal rows in the first pattern, for instance at least 6 and often at least 10 and typically up to 20, 30 or even 40 rows. It is generally impracticable to have more than about 50 or 60 rows around a typical rod. The second pattern can consist of a single transverse row or can comprise a plurality of transverse rows. Although the number can be large it is generally preferably less than the number of longitudinal rows and so is normally below 10, usually below 5, typically 1–3. It is often preferred to have a relatively large number (e.g. 8 to 30) of longitudinally extending first rows and a single transversely extending second row, or two second rows.

Within each of the rows, the perforations are preferably regularly spaced.

BRIEF DESCRIPTION OF THE DRAWINGS

In the accompanying drawings

DETAILED DESCRIPTION OF THE PREFERRED EMBODIMENT

Figure 5:
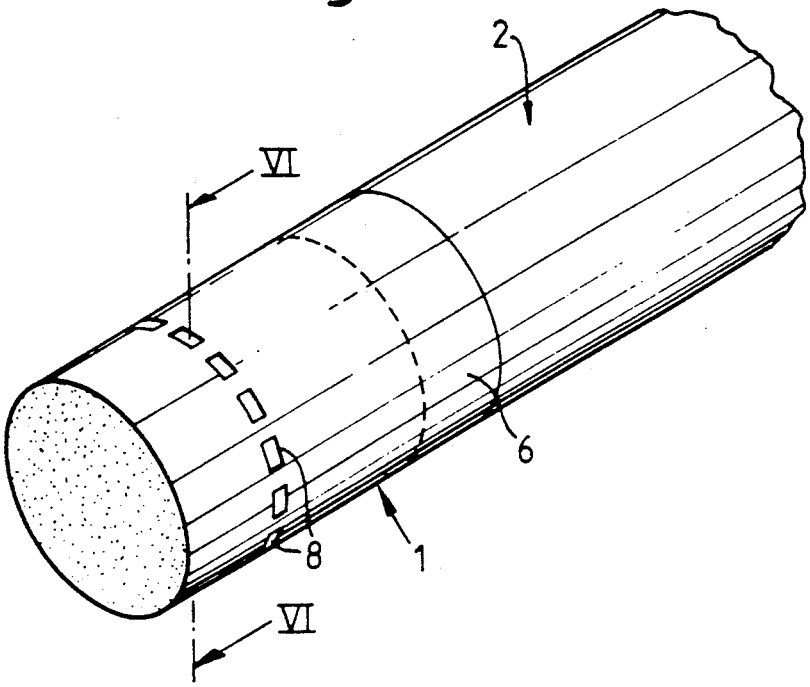
FIG. 5 is a perspective view of a rod.
Figure 6:
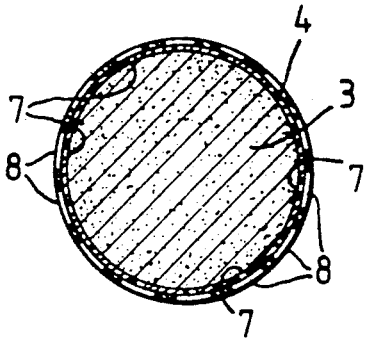
FIG. 6 is a cross-section on the line VI—VI.

As shown in FIGS. 5 and 6, the tipped smoking rod is formed of a filter tip and a tobacco rod 2. The tip 1 comprises a filter body 3 enclosed within plugwrap material 4 and is surrounded by tipping overwrap 5 that extends along the adjacent end 6 of the tobacco rod 2. These are perforations 7 in the plugwrap and perforations 8 in the overwrap.

Figure 1:
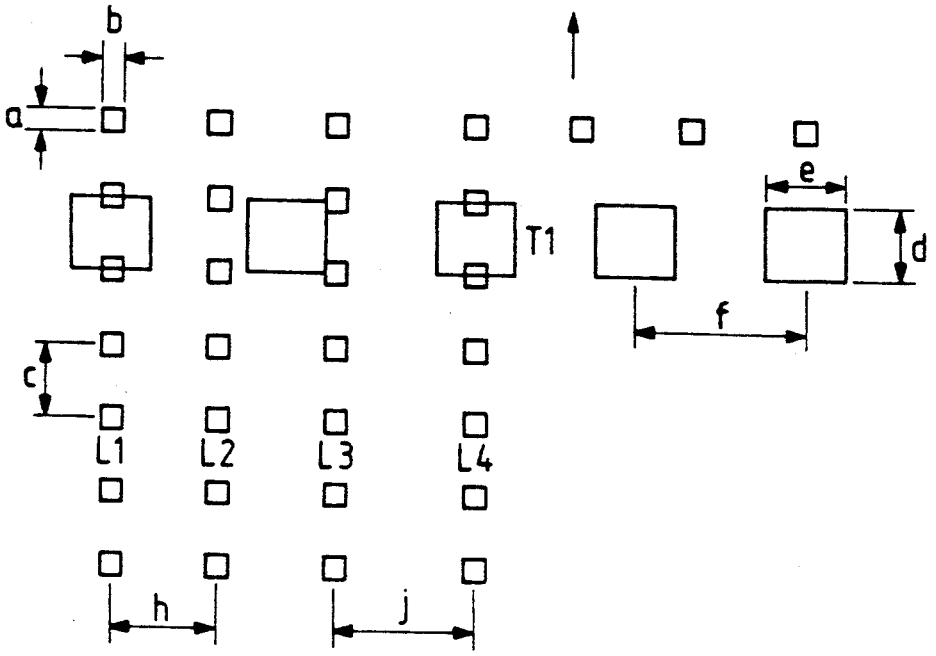
FIG. 1 shows a pattern of first and second rows formed from a plurality of first rows L1, L2, L3, L4 and so forth and a single transverse second row T1, wherein the longitudinal direction of the smoking rod is in the direction of the arrow.
Figure 2:
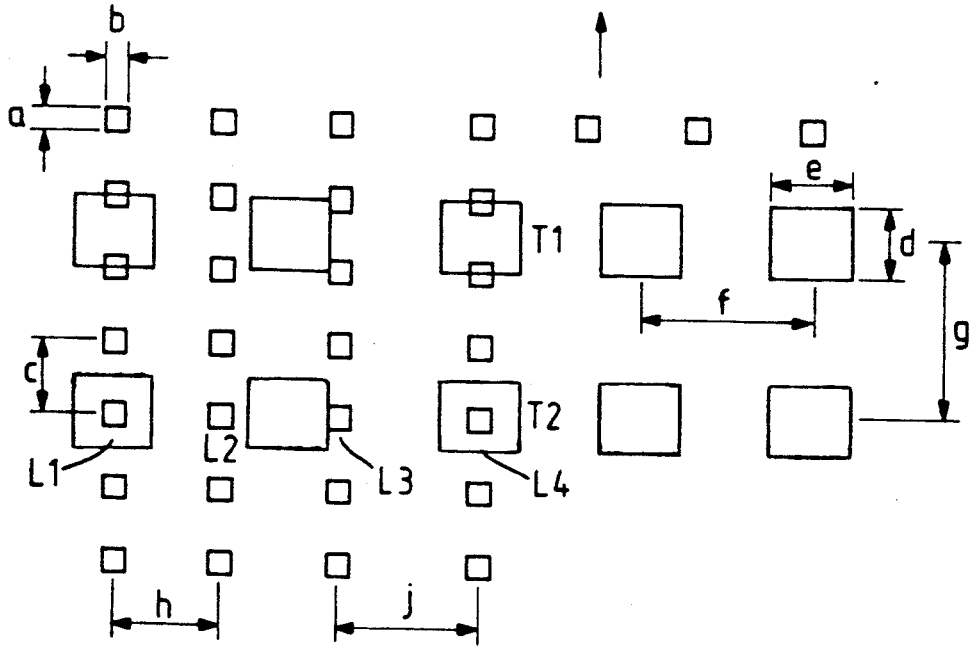
FIGS. 2, 3 and 4 show modifications in which there are two transverse rows T1, and T2.

Referring to FIG. 1, the first perforations are the perforations within each longitudinal row, L1, L2 etc. They are regularly spaced and have a longitudinal dimension a, a transverse dimension b and a longitudinal pitch (the longitudinal separation between centres of adjacent perforations) of c. The second perforations are the perforations in the transverse rows T1 (and T2) and these have a longitudinal dimension (i.e. a dimension in the length direction of the smoking rod) of d, a transverse dimension e and a transverse pitch f. The transverse pitch between rows L1 and L2 is h and the longitudinal pitch between rows T1 and T2 (when present) is g.

It is possible for the first and second perforations all to be very small, for instance all in the range 0.05 to 0.3 mm in each dimension, but it is generally preferred for one set of the perforations to be relatively large and have at least one dimension of at least 0.3 mm in which event the other perforations can be of similar size or can be smaller. It is often preferred for the second perforations (in the transverse rows) to be of the relatively large type, so that the first perforations can then be of similar size or smaller.

Dimensions of below 0.01 mm are inconvenient to provide and tend to give inadequate ventilation and dimensions above 1 mm are also inconvenient to provide, can give excessive ventilation, and can weaken the structure and spoil the appearance, especially by tar staining.

In order that the patterns give a constant amount of overlap irrespective of longitudinal displacement of the sheet materials relative to one another, it is preferred that $c=d/x$ where x is an integer of at least 1 provided that c is at least 1.5a. Thus x must not be selected so large that c is less than 1.5a, and preferably c is at least 2 a. This is because if c is not sufficiently larger than a, the area of perforation will be so large, relative to the area of lands between each perforation, that the sheet material is liable to tear. Preferably the width of the land between two perforations is near to or greater than the width of each of the perforation.

In the illustration shown in the drawings, $c=d$ and so x is 1, and this is often preferred, especially when there is a single transverse second row T1. However when there are a plurality of transverse second rows (i.e. at least 2) then a satisfactory longitudinal pattern is obtained when $c=$ $$\frac{d+yg}{x}$$

where y is 0 or an integer and x is an integer of at least 1 subject to c being greater than 1.5a. Often y is 0, in which event c again $=d$ when x is 1, or $c=d/2$ or $d/3$ when x is 2 or 3, as before. If it is desired for the first perforations to be spaced more widely than d, the spacing is increased by the pitch g when y is 1, or twice the pitch g when y is 2, and so forth.

Generally x and y are each never more than 3, though in theory y could be larger, eg up to 5 or even 10.

With these arrangements, the extent of overlap is constant, irrespective of the longitudinal positioning of the row T1 with respect to the longitudinal rows L1, L2 and so forth. It is a particularly convenient arrangement when, as shown, the second perforations are relatively large with d and e both being at least 0.3 mm and with the dimensions a and b of the first perforations being not more than 0.4 mm but also being sufficiently below the values of d and e that the area of each of the first perforations is not more than 70%, typically 10–50% of the area of each of the second perforations. Conveniently the first perforations can then be termed micro-perforations and the second perforations macro-perforations.

However the invention is also applicable where all the perforations are of similar size, for instance with every dimension being above 0.2 mm or above 0.3 mm. Such perforations can be square or elongated rectangles.

When they are elongated rectangles it is particularly preferred that the elongated rectangles in the first rows should extend at right angles to the elongated rectangles in the second rows. Thus either $a>b+0.1$ mm and $e>d+0.1$ mm or $b>a+0.1$ mm and $d>e+0.1$ mm. Preferably the difference between the dimensions is at least 0.2 mm. For instance the rectangles may have a length direction of 0.5 mm and a width direction of 0.3 mm. This offset arrangement of rectangles facilitates the attainment of a substantially uniform degree of overlap irrespective of the radial positioning of the first and second sheet materials, and it also provides an area of overlap between perforations that is smaller than the area of each perforation. This can be desirable from a visual point of view.

Figure 3:
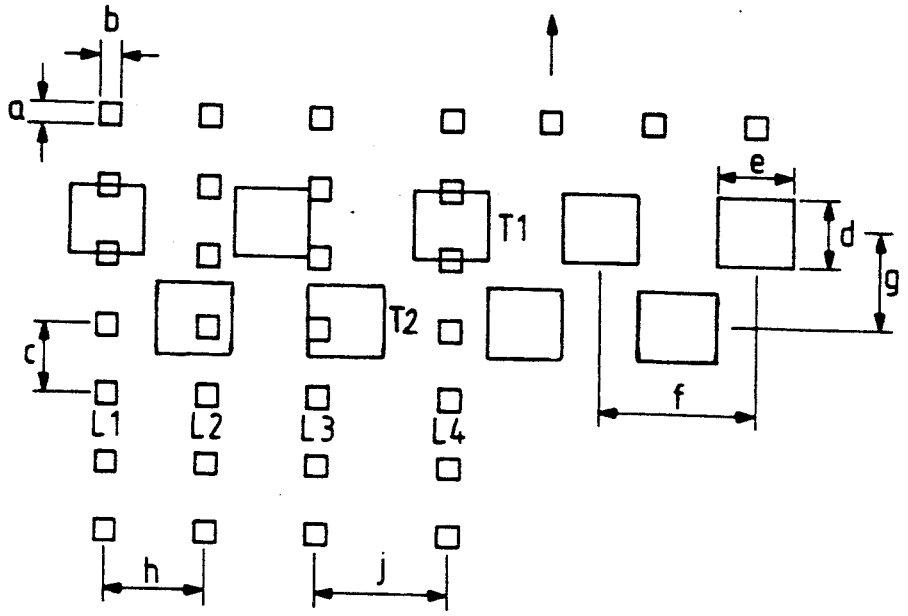

Another way of facilitating uniform overlap irrespective of the radial displacement of the first and second sheet materials is to provide a plurality of second rows with the second perforations arranged in the second rows so as to co-extend over part or all of the land between each second perforation in a neighbouring second row. This arrangement can take the form shown in FIG. 3, where each perforation in row T2 is exactly co-extensive with the land between each perforation in row T1, and so the rows T1 and T2 will serve as being equivalent to a single slot having a longitudinal length d, but the lands in the rows T1 and T2 will prevent tearing.

Figure 4:
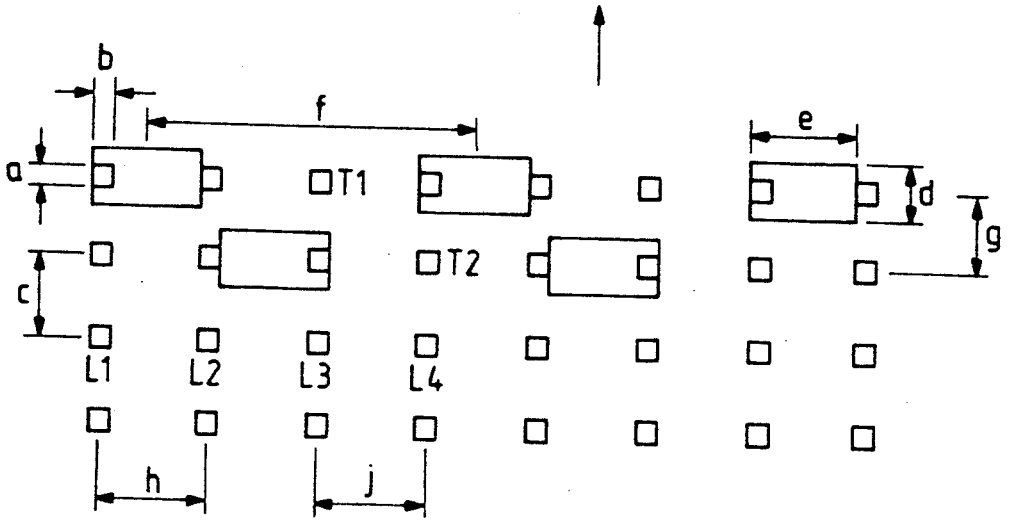

Alternatively, as is shown in FIG. 4, each perforation in row T2 co-extends over only part of the land between each perforation in row T1, so that there is a transverse spacing between each second perforation in T1 and each transversely adjacent second perforation in T2.

With either of such arrangements the longitudinally extending first rows can be arranged randomly or regularly around the filter tip and the amount of overlap of perforations will be unaffected by the radial positioning of the sheet materials. However for most purposes it is necessary for the first rows to be arranged transversely with respect to one another in an appropriate pattern that will give the constant degree of overlap.

These patterns are obtained when the pitch $h=$ $$\frac{e+vf}{w}$$

where v is 0 or an integer greater than 1 and w is an integer of at least 1, provided that h is greater than 1.5b and is preferably at least 2 b, so as to minimise tearing. When v is 0, the transverse pitch h in adjacent first rows is equal to the transverse width e of each second perforation (as shown in FIG. 4) except when w is, for instance, 2 in which case it is equal to half the width e. Generally w is never more than 3, and preferably it is 1. When v is 1 (and w is 1) the pitch h between adjacent first rows is increased by the pitch f between adjacent perforations within the second rows. Generally v is either 0, 1 or 2 but in some instances it can be much higher, eg up to 4 or even up to 10 or more.

The first rows can extend around the entire periphery of the smoking rod with a pitch h between all adjacent rows and this will give substantially uniformity of ventilation irrespective of the radial position provided the periphery of the rod is appropriate to permit an exact number of rows around the periphery. However it is unnecessary for this, and preferably the first rows are arranged in bands, with each band consisting of zn rows separated by pitch h where z is an integer, usually 1 but possibly 2, 3 or some higher number, and n is the minimum number of rows required to give a recurring transverse pattern of superimposition of second perforations on first perforations. In the drawings rows L1, L2 and L3 constitute one band of rows each separated by a pitch h, and L4 is the beginning of another band of rows, with the pitch j between the adjacent rows L3 of one band and L4 of the next being different from the pitch h of the rows within each band. As shown in the figures, the bands are in side-by-side relationship and this is a simple arrangement to design, especially when the number of rows in each band is relatively low, eg 2 to 10, preferably 2 to 6.

However it is sometimes desirable, especially when the number of rows in a band is relatively high, eg above 5 and often above 10 or 15, for the bands to be in overlapping relationship, with the result that adjacent rows within an area of overlap of the two bands will have a pitch of less than h. For instance row L4 of one band might be positioned between rows L2 and L3 of another band and so the separation between rows L2 and L4 and between rows L4 and L3 will each be less than h, even though the pitch between rows within a band remains h.

The number of rows that are required to be within each band is dictated by the relative dimensions e and f and can be calculated in conventional manner (as shown in the examples) so as to obtain a recurring transverse pattern of overlap between the first and second patterns. Thus, rows L1 and L4 are exactly central to perforations in the row T1 and so each marks the beginning of a band. Irrespective of the transverse displacement of the second perforations with respect to the longitudinal rows, the area of overlap will be constant.

The number of bands, and the spacing between bands, is dictated by the area of perforation through the laminate that is required. For instance if the degree of ventilation requires an area equivalent to 4 holes of the first pattern in FIG. 1, there will be 4 bands spaced uniformly (or randomly) around the rod.

It is possible for the transverse rows to be in the plugwrap and for the longitudinal rows to be in the tipping overwrap but this arrangement has some disadvantages, including difficulty of manufacture. Accordingly it is generally preferred for the longitudinal rows to be in the plugwrap, so that the first sheet material is the plugwrap and the second sheet material is the tipping overwrap. It is possible for the perforations in the tipping overwrap to be relatively small (each dimension below 0.3 mm), but it is particularly preferred for the second sheet material to be the tipping overwrap and to have a single row, or not more than 2 or 3 rows of clearly visible perforations, for instance d and e both being in the range 0.3 to 1 mm. Thus, by the invention, it is possible to have a single transverse row, or a few transverse rows, of perforations through brown tipping overwrap that are sufficiently large that white plugwrap underneath can be seen, and yet it is also possible to ensure that the size of overlap of these tipping overwrap perforations with the plugwrap perforations is sufficiently small that staining of the white areas is not noticeable during use. This is achieved provided the overlap area of each second perforation that is overlapped by a first perforation is sufficiently small, and generally it must be below 50% of the white area and preferably has dimensions of below 0.3 mm, and often below 0.2 mm.

Although it is possible to achieve the regular overlap with oval or other shaped perforations, it is preferred that the perforations should be substantially rectangular, especially those perforations having a dimension of at least 0.3 mm.

It is generally not convenient, in the invention, to make the desired perforations by electrostatic perforation techniques since they do not permit the regular and predetermined positioning that is required in the invention, and cutting techniques are inconvenient for perforations of the sizes desired in the invention. It is therefore preferred that the first and second perforations should be made either by mechanical abrasion techniques or by laser perforating techniques. The mechanical abrasion techniques are well known and are particularly suitable for perforations having a dimension above 0.3 mm. The laser perforating techniques are well known and are particularly suitable for perforations having dimensions below 0.3 mm. Laser perforating can be used for making larger perforations but tends to be slow and uneconomic and is best used for the smaller perforations, especially up to 0.25 mm. For instance mechanical perforation may be used for the tipping overwrap and laser perforation or mechanical perforation for the plugwrap.

The design of the first and second patterns is such that the desired degree of ventilation is achieved and, as a result of the invention, this degree is substantially unaffected by the relative positioning of the two sheet materials. The extent of ventilation can be from 10% to 95% ventilation, but is generally in the range 40 to 85%, often 40 to 60% ventilation. The amount of perforation overlap usually must be at least 0.2 $mm^2$ as otherwise the degree of ventilation will be too low in most instances to be useful. It is generally at least 0.3 $mm^2$, generally in the range 0.4 to 0.8 $mm^2$, often around 0.4 to 0.6 $mm^2$. The desired area of perforation overlap can be precalculated in conventional manner based on conventional ventilation models for the components of the tobacco rod and filter body. The sheet materials are preferably substantially impermeable, so that ventilation is preferably due solely to the overlap.

Having decided on the desired area of overlap, the first and second patterns can then be designed. Often one of the patterns is previously dictated by other considerations (for instance a single row of relatively large perforations in the tipping overwrap) in which event the pattern in the other sheet material will then be designed so as to give the desired degree of overlap and uniformity of overlap. The coefficient of variation between the ventilation values (and thus between the degrees of overlap between the first and second patterns) of smoking rods according to the invention is preferably below 15% and most preferably is below 12%, with values of 10% or less, eg down to 7% or even 5%. The lowest possible value is desirable. In general, the variability in the invention should be not substantially worse than the variability that is obtained when there is a row of perforations in the tipping overwrap and the plugwrap has natural random permeability and no perforations. The coefficient of variation in such combinations typically ranges between 5 and 12%, often between 5 and 10%, and this is the level of variability that is suitable in the invention. When randomly perforated sheet material (eg by electrostatic perforation) is superimposed on a tipping overwrap having a single row of perforations, the coefficient of variation typically is above 15%, eg 18 or 20% and this is unacceptable.

The invention includes plugwrap that has been provided with a pattern appropriate to a predetermined pattern on tipping overwrap, and tipping overwrap that has been provided with a pattern that is appropriate for a predetermined pattern in the plugwrap material.

Thus the invention includes also plugwrap material (and filter tips enclosed within such plugwrap material) that is substantially impermeable sheet material and that has been provided with a first pattern of first longitudinally extending rows regularly spaced first perforations, wherein the first pattern is such that it is easy then to design a transverse pattern in the tipping overwrap and will co-operate with the first pattern to give the desired uniform degree of overlap and ventilation. In particular, the first pattern, preferably comprises at least 6, and often 10 to 20, 30 or more longitudinally extending rows regularly spaced first perforations that are all between 0.01 and 1 mm in each dimension, wherein the rows are either regularly spaced or are arranged in bands of at least two rows wherein the rows within each band are regularly spaced. With such plugwrap material, it is then relatively easy to design a second pattern in the tipping overwrap (for instance a single transverse row of larger perforations) that will give the desired uniform degree of overlap.

The filter body may be of homogeneous construction, for instance being of conventional cellulose acetate tow filament or Myria paper construction, or the filter body can be of heterogeneous construction for instance as described in GB 2,091,078, U.S. Pat. No. 4,564,030 or EP 255,114. For instance a hollow cylinder of permeable or perforated material may be interposed between the main filter material and the cigarette rod (as in GB 2,091,078) and some or all of the perforations may lead into this, and/or a mixing chamber may be provided between two lengths of filter material or between one length of filter material and a more permeable or open tipping construction, as shown in U.S. Pat. No. 4,564,030 and EP 255,114, with a mixing chamber between the two parts and with the perforations leading into this mixing chamber.

The filter tips, and the smoking rods formed using them, can be constructed in known manner except for the use of the longitudinally perforated plugwrap material and the selection of the desired relationship between the perforations in the plugwrap and the perforations in the overwrap.

As examples of the invention, a number of plugwrap-/overwrap combinations have been calculated. For convenience, the examples are written in terms of starting with a preset perforation in the overwrap, followed by the designing of an appropriate perforation in the plugwrap. However it is, of course, equally possible to start with a preset perforation in the plugwrap and then to design an appropriate perforation in the overwrap.

In each of the examples, the smoking rod was of the same composition and the filter body was also of the same composition, being a homogeneous cylinder of cellulose acetate filament tow. In each example a single transverse row of perforations extend around the filter tip at a position about one quarter of the distance from the end of the tobacco rod towards the mouth end of the filter tip.

Before calculating the perforations required in each of the examples, the total useful perforation area through the laminate of plugwrap and overwrap, to obtain any particular degree of ventilation, was plotted. It was found that 50% ventilation required a total useful perforation area of 0.6 $mm^2$. 40% ventilation required about 0.3 $mm^2$ and 60% ventilation about 0.6 $mm^2$. In all examples the transverse dimension (ie peripheral length) was the conventional smoking rod length of 19.5 mm.

In each of the examples the permeability of the plugwrap and filterwrap was, before perforation, so low that it made no significant contribution to the ventilation of the perforated system.

EXAMPLE 1

The tipping overwrap has a single transverse row of rectangular perforations in which d is 0.5, e is 0.5 and f is 1 mm. With this arrangement the pitch c within each row of micro perforations can be 0.5 mm, there can be two rows within each band of perforations with a pitch h of 0.5 mm and one only of each of this pair will be in register with a perforation in the overwrap. The total exposed perforation area that is required for 50% ventilation is 0.46 $mm^2$. If eight bands of micro perforations (sixteen rows in all) are provided this will provided eight exposed micro perforations, with the result that each must have an area of about 0.058 $mm^2$, i.e., a and b each about 0.27 mm. The coefficient of variation is in the range 7 to 10%.

EXAMPLE 2

In this example, 50% ventilation is required when the perforations in the overwrap have d and e each 0.5 mm and f 0.83 mm (i.e., twelve perforations to the centimeter). A convenient way of achieving this is to provide micro perforations that have a longitudinal pitch c of 0.5 and which are arranged in bands of five rows having a transverse pitch h of 0.5 mm, since this will expose three perforations in each band at any one time. Nine perforations will thus be exposed if the perforations in the plug wrap are arranged as three groups of five and so, to give 50% ventilation, each micro hole should have an area of about 0.051 $mm^2$, namely a diameter of about 0.26 mm. The coefficient of variation is in the range 7 to 10%.

EXAMPLE 3

In this example the overwrap has a single row of perforations where d and e are each 0.4 mm and f is 1.25 mm (eight perforations per centimeter). With this arrangement the longitudinal pitch of the micro perforations is 0.4 mm and the micro perforations are arranged in a band of twenty five rows at a pitch of 0.4 mm with the result that eight perforations will be exposed in that group at any one time. If two of these bands are provided this will give sixteen micro perforations exposed at any one time, so that each would have an area of 0.029 $mm^2$ and a diameter of 0.19 mm. The coefficient of variation is in the range 7 to 10%.

EXAMPLE 4

The tipping overwrap has four transverse rows d=0.3, e=0.5 and f=1.5 mm and the plugwrap is provided with longitudinal rows wherein a=0.5, b=0.3 and c=1 mm and h=1.5 mm arranged in overlapping bands each consisting of two rows centrally placed with respect to each other. Thus the rows are arranged band 1-band 2, -band 1, -band 2, -band 3 -band 4, -band 3, -band 4 and so forth with a pitch of 1.5 mm between the rows in a band and a pitch of 0.75 mm between adjacent rows. This gives 16 overlapping holes giving a total hole area of 1.44 $mm^2$, each overlapping hole being 0.3 mm by 0.3 mm.

EXAMPLE 5

The tipping overwrap has two rows, e and d are each 0.5 mm and f is 1.5 mm, and the plugwrap has longitudinal rows wherein a and b are each 0.5 mm, c is 1 mm and h is 1.5 mm. These longitudinal rows are arranged in pairs with a spacing j of 1 mm between the closest rows in each pair. This gives a total area of overlap of 2 $mm^2$.

We claim:

1. A tipped smoking rod comprising a tobacco rod, a filter tip adjacent one end of the tobacco rod and comprising a filter body enclosed within plugwrap material, and a tipping overwrap material around the filter tip and the said adjacent end of the tobacco rod, and in this smoking rod, the plugwrap material is selected from first and second sheet materials and the tipping overwrap material is the other of the first and second sheet materials, the first sheet material is a substantially impermeable sheet material that has been provided with a first pattern of first perforations, and the second sheet material is a substantially impermeable sheet material that has been provided with a second pattern of second perforations, wherein the perforations are all between 0.01 and 1 mm in each dimension, the first pattern comprises one or a plurality of parallel first rows of first perforations in a predetermined arrangement within each row, the second pattern comprises one or a plurality of parallel second rows of second perforations in a predetermined arrangement within each row, the first and second patterns are selected such that there is an area of overlap of first and second perforations that is at least 0.2 $mm^2$ and that is substantially unaffected by the relative positions of the tipping and the plugwrap materials.

2. A smoking rod according to claim 1 wherein the first sheet material comprises plugwrap and the second sheet material comprises tipping overwrap.

3. A plurality of smoking rods each comprising:

a tobacco rod, a filter tip adjacent one end of the tobacco rod and comprising a filter body enclosed within plugwrap material, and a tipping overwrap material around the filter tip and the said adjacent end of the tobacco rod, and in this smoking rod the plugwrap material is selected from first and second sheet materials and the tipping overwrap material is the other of the first and second sheet materials, the first sheet material is a substantially impermeable sheet material that has been provided with a first pattern of first perforations, and the second sheet material is a substantially impermeable sheet material that has been provided with a second pattern of second perforations, wherein the perforations are all between 0.01 and 1 mm in each dimension, the first pattern comprises one or a plurality of parallel first rows of first perforations in a predetermined arrangement within each row, the second pattern comprises one or a plurality of parallel second rows of second perforations in a predetermined arrangement within each row, the first and second patterns are selected such that there is an area of overlap of first and second perforations that is at least 0.2 $mm^2$ and that is substantially unaffected by the relative positions of the tipping overwrap and the plugwrap materials, wherein the coefficient of variation between the ventilation values of the smoking rods is below 12%.

4. A plurality of smoking rods according to claim 3 wherein in each rod at least one of the first and second patterns comprises a plurality of rows.

5. A plurality of smoking rods according to claim 3 wherein in each rod the first rows in the first pattern extend longitudinally and the second rows in the second pattern extend transversely.

6. A plurality of smoking rods according to claim 5 wherein in each rod the number of second transverse rows in the second pattern is less than the number of first longitudinal rows in the first pattern.

7. A plurality of smoking rods according to claim 6 wherein in each rod the number of first longitudinal rows is between 6 and 60, and the number of second transverse rows is below 10.

8. A plurality of smoking rods according to claim 6 wherein the number of first rows is 8 to 30 and the number of second rows is 1 to 3.

9. A plurality of smoking rods according to claim 3 wherein, in each rod, the area of each perforation of one set of perforations is 10% to 70% of the area of each perforation of the other set of perforations.

10. A plurality of smoking rods according to claim 3 in which, in each rod, the second perforations are larger than the first perforations and are arranged in transverse rows.

11. A plurality of smoking rods according to claim 3 wherein, in each rod, the perforations are square or elongated rectangles and the difference between the longitudinal dimension of the elongated rectangles in the first sheet material and the transverse dimensions of the elongated rectangles in the second sheet material is at least 0.1 mm.

12. A plurality of smoking rods according to claim 3 wherein each rod comprises a plurality of second rows with second perforations arranged in the second rows to co-extend over part or all of the land between each second perforation in a neighbouring second row.

13. A plurality of smoking rods according to claim 3 wherein in each rod the first rows extend around the entire periphery of the smoking rod with constant transverse pitch between the first rows.

14. A plurality of smoking rods according to claim 3 wherein in each rod the first rows are arranged in bands which comprise zn rows separated at constant transverse pitch within the bands, where z is an integer and n is the minimum number of rows required to give a recurring transverse pattern of superimposition of second perforations on first perforations.

15. A plurality of smoking rods according to claim 3 wherein in each rod the amount of perforation overlap is at least 0.3 $mm^2$.

16. A plurality of smoking rods according to claim 3 wherein in each rod both the first and second rows extend longitudinally and the perforations in the said rows are staggered with respect to each other in the transverse direction.

17. A plurality of smoking rods according to claim 3 wherein the first sheet material comprises plugwrap and the second sheet material comprises tipping overwrap.

18. A smoking rod comprising a tobacco rod, a filter tip adjacent one end of the tobacco rod and comprising a filter body enclosed within plugwrap material, and a tipping overwrap material around the filter tip and the said adjacent end of the tobacco rod, and in this smoking rod the plugwrap material is selected from first and second sheet materials and the tipping overwrap material is the other of the first and second sheet materials, the first sheet material is a substantially impermeable sheet material that has been provided with a first pattern of first perforations, and the second sheet material is a substantially impermeable sheet material that has been provided with a second pattern of second perforations, wherein the perforations are all between 0.01 and 1 mm in each dimension, the first pattern comprises one or a plurality of parallel first rows of first perforations in a predetermined arrangement within each row, the second pattern comprises one or a plurality of parallel second rows of second perforations in a predetermined arrangement within each row, the first and second patterns are selected such that there is an area of overlap of first and second perforations that is at least 0.2 $mm^2$ and that is substantially unaffected by the relative positions of the tipping overwrap and the plugwrap materials wherein c=

$$\frac{d + yg}{x}$$

where c is the longitudinal pitch of the first perforations, d is the transverse pitch between the transverse second rows, y is 0 or an integer up to 10, and x is an integer of at least 1, wherein x and y are selected to give c of at least 1.5a, wherein a is the longitudinal dimension of the first perforations.

19. A rod according to claim 18 wherein c is at least 2a.

20. A smoking rod according to claim 18 wherein the first sheet material comprises plugwrap and the second sheet material comprises tipping overwrap.

21. A smoking rod comprising a tobacco rod, a filter tip adjacent one end of the tobacco rod and comprising a filter body enclosed within plugwrap material, and a tipping overwrap material around the filter tip and the said adjacent end of the tobacco rod, and in this smoking rod the plugwrap material is selected from first and second sheet materials and the tipping overwrap material is the other of the first and second sheet materials, the first sheet material is a substantially impermeable sheet material that has been provided with a first pattern of first perforations, and the second sheet material is a substantially impermeable sheet material that has been provided with a second pattern of second perforations, wherein the perforations are all between 0.01 and 1 mm in each dimension, the first pattern comprises a plurality of parallel first rows of first perforations in a predetermined arrangement within each row, the second pattern comprises a plurality of parallel second rows of second perforations arranged within each row to co-extend over part or all of the area between each second perforation in a neighbouring row, the first and second patterns are selected such that there is an area of overlap of first and second perforations that is at least 0.2 $mm^2$ and that is substantially unaffected by the relative positions of the tipping overwrap and the plugwrap materials, wherein each rod comprises a plurality of second rows with second perforations arranged in the second rows to co-extend over part or all of the land between each second perforation in a neighbouring second row, and wherein there are a plurality of first rows arranged transversely with respect to one another wherein h=

$$\frac{e + Vf}{w}$$

where h is the transverse pitch between first rows, b is the transverse dimension of the second perforations and f is the longitudinal pitch of the second perforations, v is 0 or an integer greater than 1, and w is an integer of at least 1, wherein v and w are selected to give h of at least 1.5b.

22. A rod according to claim 11 wherein h is at least 2b.

23. A smoking rod according to claim 21 wherein the first sheet material comprises plugwrap and the second sheet material comprises tipping overwrap.

* * * * *